US009136612B2

(12) United States Patent
Kwon et al.

(10) Patent No.: US 9,136,612 B2
(45) Date of Patent: Sep. 15, 2015

(54) FRONT-END APPARATUS OF WIRELESS TRANSCEIVER USING RF PASSIVE ELEMENTS

(75) Inventors: Heon Kook Kwon, Daejeon (KR); Byung Su Kang, Daejeon (KR); Jae Ho Jung, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 541 days.

(21) Appl. No.: 13/619,960

(22) Filed: Sep. 14, 2012

(65) Prior Publication Data

US 2013/0162495 A1 Jun. 27, 2013

(30) Foreign Application Priority Data

Dec. 26, 2011 (KR) ..... 10-2011-0142703

(51) Int. Cl.
*H01Q 21/28* (2006.01)

(52) U.S. Cl.
CPC ..... *H01Q 21/28* (2013.01)

(58) Field of Classification Search
CPC ..... H01Q 1/50
USPC ..... 343/852, 853, 876, 893
See application file for complete search history.

(56) References Cited

U.S. PATENT DOCUMENTS

| | | | | |
|---|---|---|---|---|
| 4,319,242 | A * | 3/1982 | Lewis | 342/67 |
| 2001/0046867 | A1* | 11/2001 | Mizoguchi | 455/452 |
| 2004/0204037 | A1 | 10/2004 | He et al. | |
| 2005/0255812 | A1* | 11/2005 | Na et al. | 455/78 |
| 2006/0125602 | A1* | 6/2006 | Posamentier et al. | 340/10.3 |
| 2011/0117862 | A1* | 5/2011 | Bagger et al. | 455/77 |
| 2011/0175789 | A1* | 7/2011 | Lee et al. | 343/853 |

FOREIGN PATENT DOCUMENTS

KR 1020040051479 6/2004

* cited by examiner

*Primary Examiner* — Dameon E Levi
*Assistant Examiner* — Hasan Islam
(74) *Attorney, Agent, or Firm* — Nelson Mullins Riley & Scarborough LLP; Anthony A. Laurentano, Esq.

(57) ABSTRACT

Disclosed is a front-end apparatus of an RF transceiver connected with an antenna in a wireless communication system. The front-end apparatus of an RF transceiver using radio-frequency passive elements includes: a plurality of band pass filters configured a transmission signal and a reception signal; a first circulator configured to output a first transmission signal to a second terminal and output a second reception signal input; a second circulator configured to output a second transmission signal input into the first terminal to the second terminal and output a first reception signal input into the second terminal to the third terminal; a passive directional double pole and double throw switch configured to process a route to be changed depending on directions of an input and an output; a first antenna configured to transmit the first transmission signal; and a second antenna configured to transmit the second transmission.

14 Claims, 4 Drawing Sheets

FRONT-END APPARATUS OF WIRELESS TRANSCEIVER USING RF PASSIVE ELEMENTS

CROSS-REFERENCE TO RELATED APPLICATIONS

This application is based on and claims priority from Korean Patent Application No. 10-2011-0142703, filed on Dec. 26, 2011, with the Korean Intellectual Property Office, the disclosure of which is incorporated herein in its entirety by reference.

TECHNICAL FIELD

The present disclosure relates to a front-end apparatus of an RF transceiver connected with an antenna in a wireless communication system, and more particularly, to a front-end apparatus of an RF transceiver using radio-frequency passive elements in a wireless communication system supporting multiple antennas, a dual mode, and a dual band.

BACKGROUND

Emergence and development of various wireless communication systems have brought about a lot of changes in a wireless transceiver. In particular, a dual mode and dual band system having a communication velocity improved by using multiple antennas (multiple input multiple output: MIMO) or configured of a single system with plural integrated wireless communication systems increases.

Further, for the wireless communication system, there are two representative combination schemes of a transceiver and an antenna. One is a time division duplexing (TDD) in which transmission and reception are temporally combined. That is, in this scheme, transmission and reception have the same carrier frequency, and the antenna is used by temporally dividing transmission and reception. The other one is a frequency division duplexing (FDD) in which transmission and reception are combined by the frequency. In this scheme, the antennas are used at the same time by setting different carrier frequencies of transmission and reception. In the two combination schemes, the TDD uses a switch and the FDD uses a filter in connection with the antenna.

Meanwhile, when a front-end supporting both the TDD and FDD schemes is configured, systems of various modes may be provided as one system.

Further, since a transmission/reception front-end of the wireless communication system generally needs to transfer a high-power transmission signal to the antenna, high-power active elements are required. In particular, in the case of the TDD, a single pole and double throw (SPDT) switch is used in order to discriminate transmission and reception, and to this end, a high-power switch is required. Switching a high-power signal needs to use the high-priced and high-power active element.

The single pole and double throw (SPDT) switch or a double pole and double throw (DPDT) switch is used to select a mode or a band for implementing the dual mode or dual band system. Even in this case, the switching of the high-power signal is required.

SUMMARY

The present disclosure has been made in an effort to provide a front-end apparatus of an RF transceiver using radio frequency passive elements by configuring a front-end of a wireless transceiver which can be connected with a plurality of antennas by using a circulator which is a low-cost passive element and support a dual mode or a dual band.

The present disclosure also has been made in an effort to provide a front-end apparatus of an RF transceiver using radio-frequency passive elements which can be applied to an MIMO system using a plurality of antennas through a single front-end by configuring a front end by using a plurality of circulators of which routes depend on a signal direction and connect a dual mode or dual band system and respective antennas corresponding thereto to support the dual mode or dual band system and the antennas.

The present disclosure also has been made in an effort to provide a front-end apparatus of an RF transceiver using radio-frequency passive elements that can configure a low-cost front end of a wireless transceiver by substituting a high-cost and high-power switch by using the low-cost and radio-frequency passive element.

An exemplary embodiment of the present disclosure provides a front-end apparatus of an RF transceiver using radio-frequency passive elements, including: a plurality of band pass filters configured to band-pass filter a transmission signal and a reception signal in transmission and reception frequency bands corresponding thereto, respectively; a first circulator configured to output a first transmission signal input into a first terminal to a second terminal and output a second reception signal input into the second terminal to a third terminal; a second circulator configured to output a second transmission signal input into the first terminal to the second terminal and output a first reception signal input into the second terminal to the third terminal; a passive directional double pole and double throw switch configured to process a route to be changed depending on directions of an input and an output with circulators provided in four input/output terminals, respectively; a first antenna configured to transmit the first transmission signal switched through the passive directional double pole and double throw switch to a wireless channel; and a second antenna configured to transmit the second transmission signal switched through the passive directional double pole and double throw switch to the wireless channel.

Another exemplary embodiment of the present disclosure provides a front-end apparatus of an RF transceiver using radio-frequency passive elements, including: a first circulator configured to output a first transmission signal input into a first terminal to a second terminal and output a second reception signal input into the second terminal to a third terminal; a second circulator configured to output a second transmission signal input into the first terminal to the second terminal and output a first reception signal input into the second terminal to the third terminal; a passive directional double pole and double throw switch configured to process a route to be changed depending on directions of an input and an output with circulators provided in four input/output terminals, respectively and including a plurality of band pass filters configured to band-pass filter signals transmitted among the respective circulators in transmission and reception frequency bands corresponding thereto, respectively; a first antenna configured to transmit the first transmission signal switched through the passive directional double pole and double throw switch to a wireless channel; and a second antenna configured to transmit the second transmission signal switched through the passive directional double pole and double throw switch to the wireless channel.

Effects of the Present Disclosure are as Follows.

According to the configuration of the present disclosure, costs can be saved by substituting a high-cost and high-power switch by using the circulator which is the low-cost passive element as a radio frequency front end required in the wireless communication system.

Further, the single wireless transceiving front end according to the present disclosure can improve the communication velocity as the multiple-antenna system is supported, and support the dual mode or dual band system.

In addition, the signal can be transferred bidirectionally so that transmission and reception are performed at the same time to support both the TDD and FDD schemes.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

The present disclosure relates to a front-end of an RF transceiver connected with an antenna in a wireless communication system supporting multiple antennas, a dual mode or a dual band.

Since the transceiving front end of the wireless communication system generally needs to transfer a high-power transmission signal to an antenna, high-power active elements are required. In this case, a switch is used to select a mode or band. A high-priced and high-power active element needs to be used for switching the high-power signal, but a high-power switch is substituted with a low-priced radio-frequency passive element in the present disclosure.

Prior to describing the present disclosure, first, the configuration of a general dual mode/dual band wireless transceiving front end will be described. The general dual mode/dual band wireless transceiving front end is configured as illustrated in FIGS. 1 and 2, respectively according to TDD and FDD which are combination schemes with the antenna.

Figure 1:
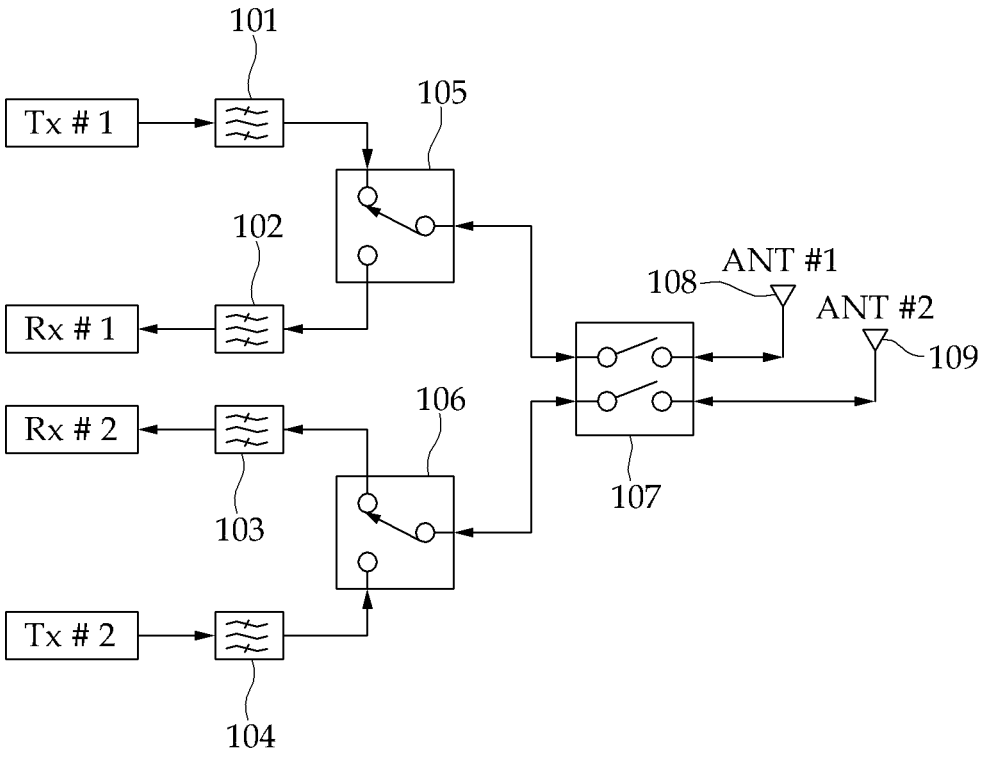
FIG. 1 is a diagram illustrating a dual mode/dual band front end of a general TDD system.

Referring to FIG. 1, a general TDD scheme wireless transceiving front end may be configured to include a plurality of band pass filters (hereinafter referred to as 'BPF') 101, 102, 103 and 104, a plurality of single pole and double throw (SPDT) switches 105 and 106, a double pole and double throw (DPDT) switch 107, and a plurality of antennas 108 and 109.

The TDD scheme as a method using an antenna by temporally dividing transmission and reception by the switch uses two TDD systems in different modes or different bands which are connected with the antennas 108 and 109 by the DPDT switch 108.

Figure 2:
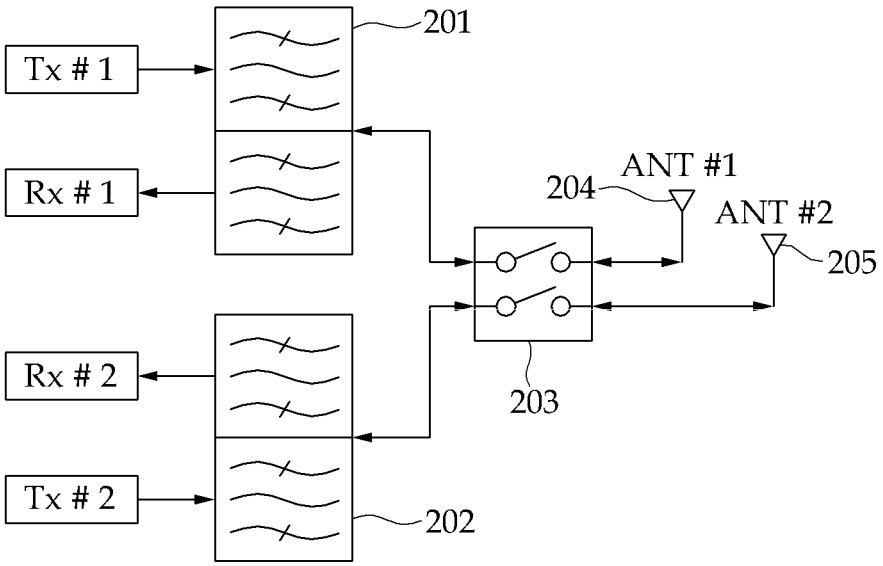
FIG. 2 is a diagram illustrating a dual mode/dual band front end of a general FDD system.

Referring to FIG. 2, the general FDD scheme wireless transceiving front end is configured to include a plurality of BPFs 201 and 202, a DPDT switch 203, and a plurality of antennas 204 and 208.

The FDD scheme commonly uses the antenna by dividing a transmission signal and a reception signal by a filter called a duplexer in terms of a frequency and uses two FDD systems in different modes or different bands which are connected with the antenna by the DPDT switch 203.

Meanwhile, since the SPDT switches 105 and 106 and the DPDT switch 107 of FIG. 1, and the DPDT switch 203 of FIG. 2 need to transfer the high-power signal of a transmitter to the antenna, the switch using the high-power active element is unavoidably used.

Figure 3:
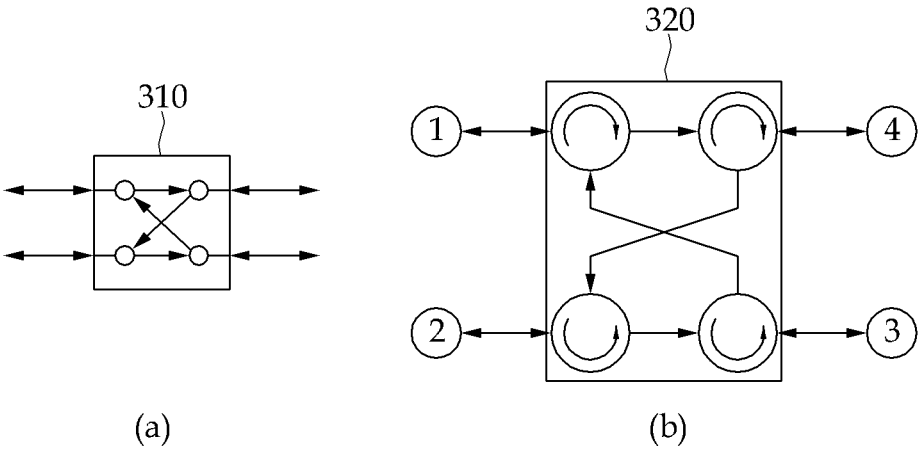
FIG. 3 is a diagram illustrating a single throw and double throw switch depending on a signal direction applied to the present disclosure.

In order to solve the problem, the present disclosure proposes a method in which a plurality of circulators which is passive elements suitable for high power at los cost as illustrated in FIG. 3 connected, such that a route is changed depending on a direction to substitute the DPDT switch.

Referring to FIG. 3, signals input into terminals 1 and 2 are output to terminals 4 and 3, respectively by directionality of the circulator, and the signals input into the terminals 4 and 3 are output to the terminals 2 and 1, respectively by the directionality of the circulator. An (The reason is that an output route corresponding to an input of a pair of #1 and 2 and an output route corresponding to an input of a pair of #4 and 3 are configured to be different from each other, and thus the route is changed depending on a direction in which the signal is input, so that the circulators operate like the DPDT switch.

Accordingly, the route is set just depending on from which side a signal which is not externally controlled is input, and although the signals are input bidirectionally at the same time, an operation is performed such that the signals are output at the same time. Meanwhile, in the present disclosure, the device illustrated in FIG. 3 above is hereinafter referred to as a "passive directional double pole and double throw (DPDT) switch".

Figure 4:
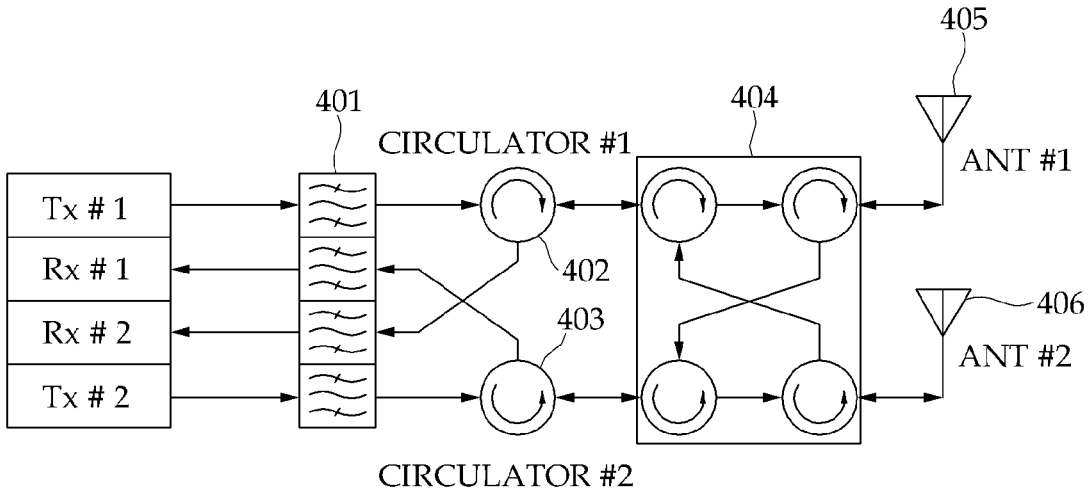
FIG. 4 is a diagram illustrating a wireless transceiving front end supporting multiple antennas according to a first exemplary embodiment of the present disclosure.

In FIG. 4, a wireless transceiving front end supporting multiple antennas 405 and 406 is configured by adding two circulators 402 and 403 and the BPFs 401 corresponding to each route by using the passive directional DPDT switch 404 of FIG. 3 according to the first exemplary embodiment of the present disclosure.

Referring to FIG. 4, two transmission signals pass through the passive directional DPDT switch 404 as they are directly via the band pass filters corresponding to the transmission signals, respectively and then via the first circulator 402 and the second circulator 403 to be transferred to the antennas 405 and 406, respectively. That is, a transmission signal #1 is transferred to the antenna #1 405 through the first circulator 402 and the passive directional DPDT switch 404 and a transmission signal #2 is transferred to the antenna #2 406 through the second circulator 403 and the passive directional DPDT switch 404.

In the case of the reception signal, as illustrated in FIG. 4, the reception signals received by two antennas 405 and 406, respectively are switched and transferred by the passive directional DPDT switch 404 and the reception signals are transferred to receivers corresponding to the respective reception signals by the first circulator 402 and the second circulator 403. That is, a reception signal #1 received by the antenna #1 405 is transferred to the second circulator 403 and the reception signal #1 transferred to the second circulator 403 is input into a receiver #1 through the BPF 401 corresponding thereto again.

That is, a reception signal #2 received by the antenna #2 406 is transferred to the first circulator 402 and the reception signal #2 transferred to the first circulator 402 is input into a receiver #2 through the BPF 401 corresponding thereto again.

As known in the description of the operation, the passive directional DPDT switch according to the exemplary embodiment of the present disclosure substitutes the DPTDT switch using the active element in the related art and simultaneously, may allow the signals to be transferred bidirectionally. In this case, the allowing of the signals to be transferred bidirectionally means that the passive directional DPDT switch may also be used as the FDD scheme wireless transceiving front end having different frequencies of transmission and reception as well as the TDD scheme wireless transceiving front end using transmission and reception by temporally dividing transmission and reception.

When the transmitters/the receivers and the antennas of #1 and #2 are used in the same frequency band, the passive directional DPDT switch may also be applied to the MIMO system using the multiple antennas.

Figure 5:
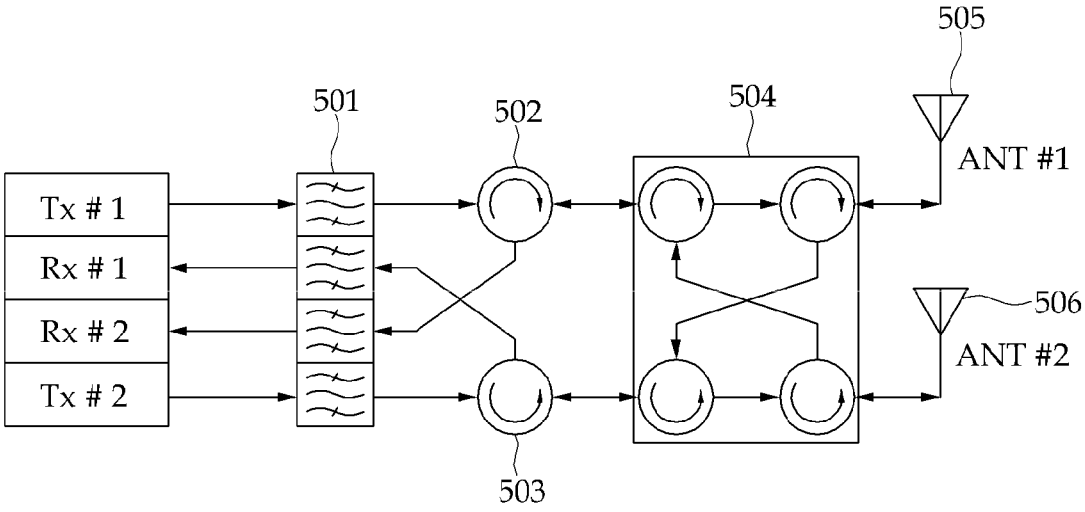
FIG. 5 is a diagram illustrating a wireless transceiving front end applied to a dual mode/dual band system according to a second exemplary embodiment of the present disclosure.

FIG. 5 illustrates an exemplary embodiment when a system in a mode or a band in which a signal #1 and a signal #2 are different from each other is implemented (an exemplary embodiment when a signal #1 and a signal #2 implement a system in different modes or bands by using a wireless transceiving front end according to a second exemplary embodiment of the present disclosure, that is, when the signal #1 and the signal #2 are used as the system in the dual mode or dual band.

FIGS. 4 and 5 are the same diagrams externally, but FIG. 4 is applied to the multiple antenna system (when a plurality of antennas are used in the same frequency band) and FIG. 5 is applied to the dual mode or dual band system (when two different frequency bands are used), and as a result, configurations of the BPF 401 and the BPF 501 are different from each other.

As illustrated in FIG. 5, the signals #1 and #2 are transferred to the transceivers and the antennas corresponding thereto, respectively through the wireless transceiving front end.

That is, the transmission signal #1 is input into the first circulator 502 through the BPF 501 and transferred from the first circulator 502 to the antenna #1 505 through the passive directional DPDT switch 504. Similarly, the transmission signal #2 is input into the second circulator 503 through the BPF 501 and transferred from the second circulator 502 to the antenna #2 506 through the passive directional DPDT switch 504.

Meanwhile, the signal received by the antenna #1 505 is input into the second circulator 503 through the passive directional DPDT switch 504, and output from the second circulator 503 to be received through the BPF 501 as a signal Rx #1. Further, the signal received by the antenna #2 506 is input into the first circulator 502 through the passive directional DPDT switch 504, and output from the first circulator 502 to be received through the BPF 501 as a signal Rx #2.

Figure 6:
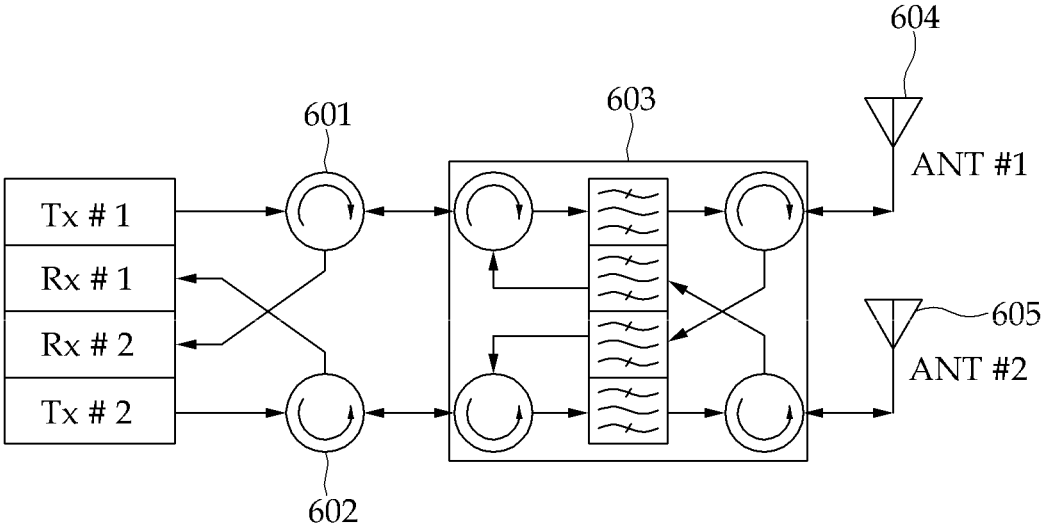
FIG. 6 is a diagram illustrating a wireless transceiving front end applied to a dual mode/dual band system according to a third exemplary embodiment of the present disclosure.

FIG. 6 illustrates another example in which the band pass filter directly connected with the transceiver is included in a passive directional DPDT switch 603 in which all of transmission and reception of #1 and #2 are separated together so as to configure the wireless transceiving front end according to a third exemplary embodiment of the present disclosure.

That is, unlike FIG. 5, the BPF is added between the respective circulators configured in the passive directional DPDT switch 603 according to the exemplary embodiment of the present disclosure, which may be applied as the dual mode or dual band system.

As illustrated in FIG. 6, the signals #1 and #2 are transferred to the transceivers and the antennas corresponding thereto, respectively, through the wireless transceiving front end.

That is, the transmission signal #1 is input into a first circulator 601 and transferred from the first circulator 601 to an antenna #1 604 through the passive directional DPDT switch 603 including the BPF. Similarly, the transmission signal #2 is input into a second circulator 602 and transferred from the second circulator 602 to an antenna #2 605 through the passive directional DPDT switch 603 including the BPF.

Meanwhile, the signal received by the antenna #1 604 is band-pass filtered and switched through the passive directional DPDT switch 603, and input into the second circulator 602 and output from the second circulator 602 to be received as the signal Rx #1. Further, the signal received by the antenna #2 605 is band-pass filtered and switched through the passive directional DPDT switch 603, and input into the first circulator 601 and output from the first circulator 601 to be received as the signal Rx #2.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A front-end apparatus of an RF transceiver using radio-frequency passive elements, comprising:

a plurality of band pass filters configured to band-pass filter a transmission signal and a reception signal in transmission and reception frequency bands corresponding thereto, respectively;

a first circulator configured to output a first transmission signal input into a first terminal to a second terminal and output a second reception signal input into the second terminal to a third terminal;

a second circulator configured to output a second transmission signal input into the first terminal to the second terminal and output a first reception signal input into the second terminal to the third terminal;

a passive directional double pole and double throw switch configured to process a route to be changed depending on directions of an input and an output with circulators provided in four input/output terminals, respectively;

a first antenna configured to transmit the first transmission signal switched through the passive directional double pole and double throw switch to a wireless channel; and a second antenna configured to transmit the second transmission signal switched through the passive directional double pole and double throw switch to the wireless channel.

2. The front-end apparatus of claim 1, wherein the passive directional double pole and double throw switch receives the first transmission signal output to the second terminal of the first circulator through a first terminal thereof and outputs the received signal through the third terminal and receives the second transmission signal output to the second terminal of the second circulator through a second terminal thereof and outputs the received signal through a fourth terminal.

3. The front-end apparatus of claim 1, wherein the passive directional double pole and double throw switch includes the circulators in four input/output terminals, respectively, the transmission signal input into the circulator of the first terminal is output through the circulator of the third terminal, and the transmission signal input into the circulator of the second terminal is output through the circulator of the fourth terminal.

4. The front-end apparatus of claim 1, wherein the passive directional double pole and double throw switch includes the circulators in four input/output terminals, respectively, the reception signal input into the circulator of the fourth terminal is output through the circulator of the first terminal, and the reception signal input into the circulator of the third terminal is output through the circulator of the second terminal.

5. The front-end apparatus of claim 1, wherein the transmission signal and the reception signal are signals in a dual mode.

6. The front-end apparatus of claim 1, wherein the transmission signal and the reception signal are signals in a dual band.

7. The front-end apparatus of claim 1, wherein the transmission signal and the reception signal are multiple input multiple output signals.

8. A front-end apparatus of an RF transceiver using radio-frequency passive elements, comprising:

a first circulator configured to output a first transmission signal input into a first terminal to a second terminal and output a second reception signal input into the second terminal to a third terminal;

a second circulator configured to output a second transmission signal input into the first terminal to the second terminal and output a first reception signal input into the second terminal to the third terminal;

a passive directional double pole and double throw switch configured to process a route to be changed depending on directions of an input and an output with circulators provided in four input/output terminals, respectively and including a plurality of band pass filters configured to band-pass filter signals transmitted among the respective circulators in transmission and reception frequency bands corresponding thereto, respectively;

a first antenna configured to transmit the first transmission signal switched through the passive directional double pole and double throw switch to a wireless channel; and a second antenna configured to transmit the second transmission signal switched through the passive directional double pole and double throw switch to the wireless channel.

9. The front-end apparatus of claim 8, wherein the passive directional double pole and double throw switch receives the first transmission signal output to the second terminal of the first circulator through a first terminal thereof and outputs the received signal through the third terminal, and receives the second transmission signal output to the second terminal of the second circulator through a second terminal thereof and outputs the received signal through a fourth terminal.

10. The front-end apparatus of claim 8, wherein the passive directional double pole and double throw switch includes the circulators in four input/output terminals, respectively, the transmission signal input into the circulator of the first terminal is output through the circulator of the third terminal, and the transmission signal input into the circulator of the second terminal is output through the circulator of the fourth terminal.

11. The front-end apparatus of claim 8, wherein the passive directional double pole and double throw switch includes the circulators in four input/output terminals, respectively, the reception signal input into the circulator of the fourth terminal is output through the circulator of the first terminal, and the reception signal input into the circulator of the third terminal is output through the circulator of the second terminal.

12. The front-end apparatus of claim 8, wherein the transmission signal and the reception signal are signals in a dual mode.

13. The front-end apparatus of claim 8, wherein the transmission signal and the reception signal are signals in a dual band.

14. The front-end apparatus of claim 8, wherein the transmission signal and the reception signal are multiple input multiple output signals.

* * * * *